US009061519B2

(12) United States Patent
Matsuda

(10) Patent No.: US 9,061,519 B2
(45) Date of Patent: Jun. 23, 2015

(54) PRINTER APPARATUS AND PRINTING METHOD

(71) Applicant: TOSHIBA TEC KABUSHIKI KAISHA, Shinagawa, Tokyo (JP)

(72) Inventor: Okiharu Matsuda, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/227,921

(22) Filed: Mar. 27, 2014

(65) Prior Publication Data

US 2014/0292989 A1 Oct. 2, 2014

(30) Foreign Application Priority Data

Mar. 27, 2013 (JP) ..... 2013-066110

(51) Int. Cl.

| | |
|---|---|
| ***B41J 2/325*** | (2006.01) |
| ***B41J 11/70*** | (2006.01) |
| ***B41J 17/08*** | (2006.01) |
| ***B41J 25/304*** | (2006.01) |

(52) U.S. Cl.

CPC *B41J 2/325* (2013.01); *B41J 11/70* (2013.01); *B41J 17/08* (2013.01); *B41J 25/304* (2013.01)

(58) Field of Classification Search

CPC ..... B41J 2/325; B41J 17/08; B41J 11/70; B41J 25/304

USPC ..... 347/171, 179, 187, 198, 213

See application file for complete search history.

(56) References Cited

U.S. PATENT DOCUMENTS

| | | | | |
|---|---|---|---|---|
| 5,021,804 | A * | 6/1991 | Nozawa et al. | 347/176 |
| 6,067,103 | A * | 5/2000 | Ewert et al. | 347/171 |
| 7,626,604 | B2 * | 12/2009 | Ihara | 347/213 |
| 7,961,107 | B2 * | 6/2011 | Hirota | 340/572.8 |
| 8,491,208 | B2 * | 7/2013 | Eoka | 400/120.17 |
| 2006/0181597 | A1 * | 8/2006 | Mindler | 347/171 |
| 2009/0115832 | A1 * | 5/2009 | Aihara | 347/217 |
| 2010/0321460 | A1 * | 12/2010 | Yoshimura et al. | 347/215 |

FOREIGN PATENT DOCUMENTS

| | | | |
|---|---|---|---|
| JP | H09-071020 | | 3/1997 |
| JP | 2007-210276 | | 8/2007 |
| JP | 2012183718 | A * | 9/2012 |

* cited by examiner

*Primary Examiner* — Sarah Al Hashimi

(74) *Attorney, Agent, or Firm* — Patterson & Sheridan LLP

(57) ABSTRACT

A printer apparatus includes a printing medium supply unit that supplies a printing medium. An ink ribbon supply unit supplies an ink ribbon. A platen roller conveys the printing medium. A thermal head is arranged at a position opposite to the platen roller with the printing medium and the ink ribbon therebetween. The thermal head carries out printing by transferring the ink of the ink ribbon to the printing medium. A head pressing mechanism changes a distance or a pressure force between the thermal head and the platen roller. After the printing is ended, a control section controls the head pressing mechanism to raise the thermal head, the printing medium conveyance unit to convey the printing medium to a cutting position, and the head pressing mechanism to lower the thermal head immediately after the printing medium is cut.

20 Claims, 5 Drawing Sheets

PRINTER APPARATUS AND PRINTING METHOD

CROSS-REFERENCE TO RELATED APPLICATION

This application is based upon and claims the benefit of priority from Japanese Patent Application No. 2013-066110, filed Mar. 27, 2013, the entire contents of which are incorporated herein by reference.

FIELD

Embodiments described herein relate a thermal transfer type printer apparatus for restricting the consumption amount of an ink ribbon, and methods for controlling a thermal transfer type printer apparatus.

BACKGROUND

A conventional thermal transfer type printer for label printing performs a feed operation to rotate a paper spool forward and feed paper having a label affixed thereto. During such a feed operation, an ink ribbon is not used and a thermal head is raised. Further, after the label printing is completed, the feed operation continues with the thermal head raised, to convey the gap section on the paper between the labels to the cutter position. After the paper is cut, a reverse feed operation rotates the paper spool backwards, to align the label for the next printing. During the reverse feed operation, the thermal head of the printer can be raised.

The ink ribbon is moved during the forward feed operation, but not during the reverse feed operation. As a result, the ink ribbon corresponding to the distance between the thermal head and the cutter is wasted.

Further, during the forward feed operation to the cutter position, if the distance between the thermal head and the cutter is short, the conveyance to the cutter position ends before the thermal head is raised even though the thermal head may be raised at a high speed. In such cases, raising of the thermal head becomes a useless operation.

DETAILED DESCRIPTION

A printer apparatus according to an embodiment includes a printing medium supply unit that supplies a printing medium. An ink ribbon supply unit supplies an ink ribbon. A platen roller conveys the printing medium. A thermal head is arranged at a position opposite to the platen roller with the printing medium and the ink ribbon therebetween. The thermal head carries out printing by transferring the ink of the ink ribbon to the printing medium. A head pressing mechanism changes a distance or a pressure force between the thermal head and the platen roller. After the printing is ended, a control section controls the head pressing mechanism to raise the thermal head, the printing medium conveyance unit to convey the printing medium to a cutting position, and the head pressing mechanism to lower the thermal head immediately after the printing medium is cut.

Hereinafter, embodiments are described in detail with reference to accompanying drawings.

A First Embodiment

Figure 1:
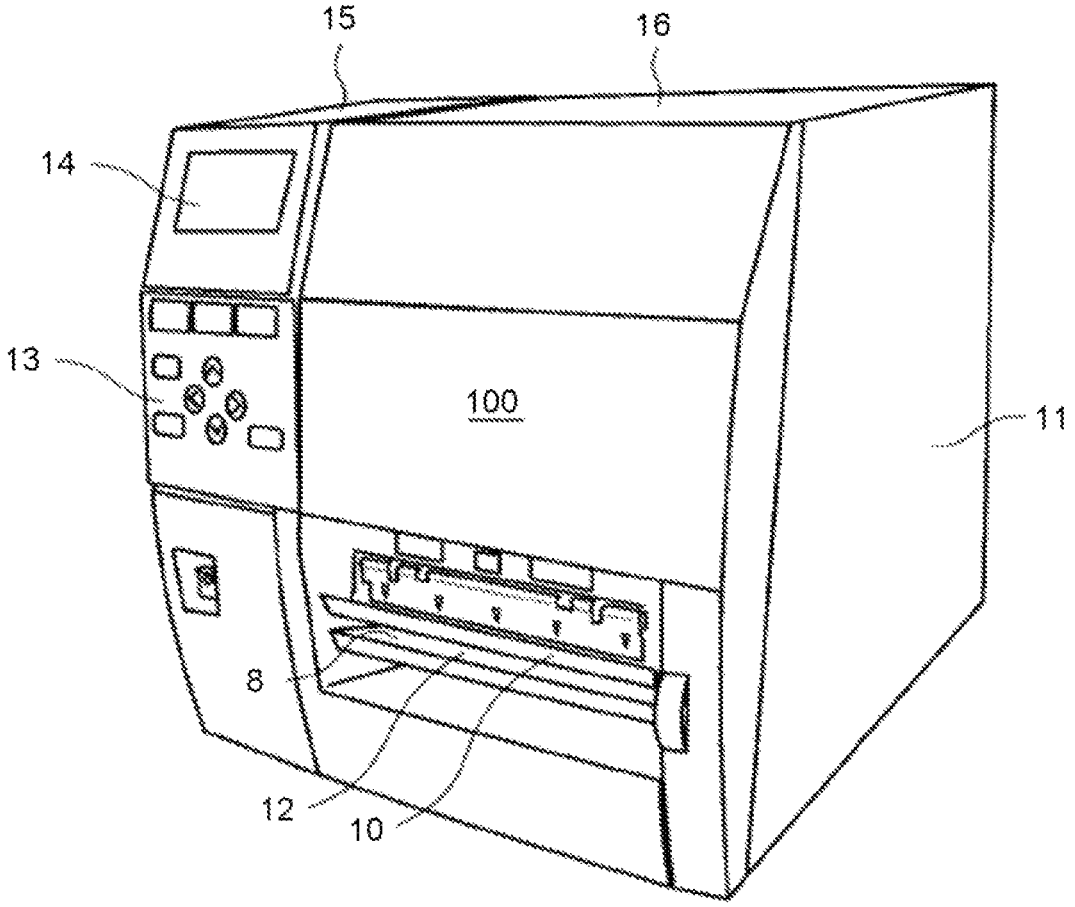
FIG. 1 is a perspective view illustrating a printer apparatus, according to a first embodiment.
Figure 2:
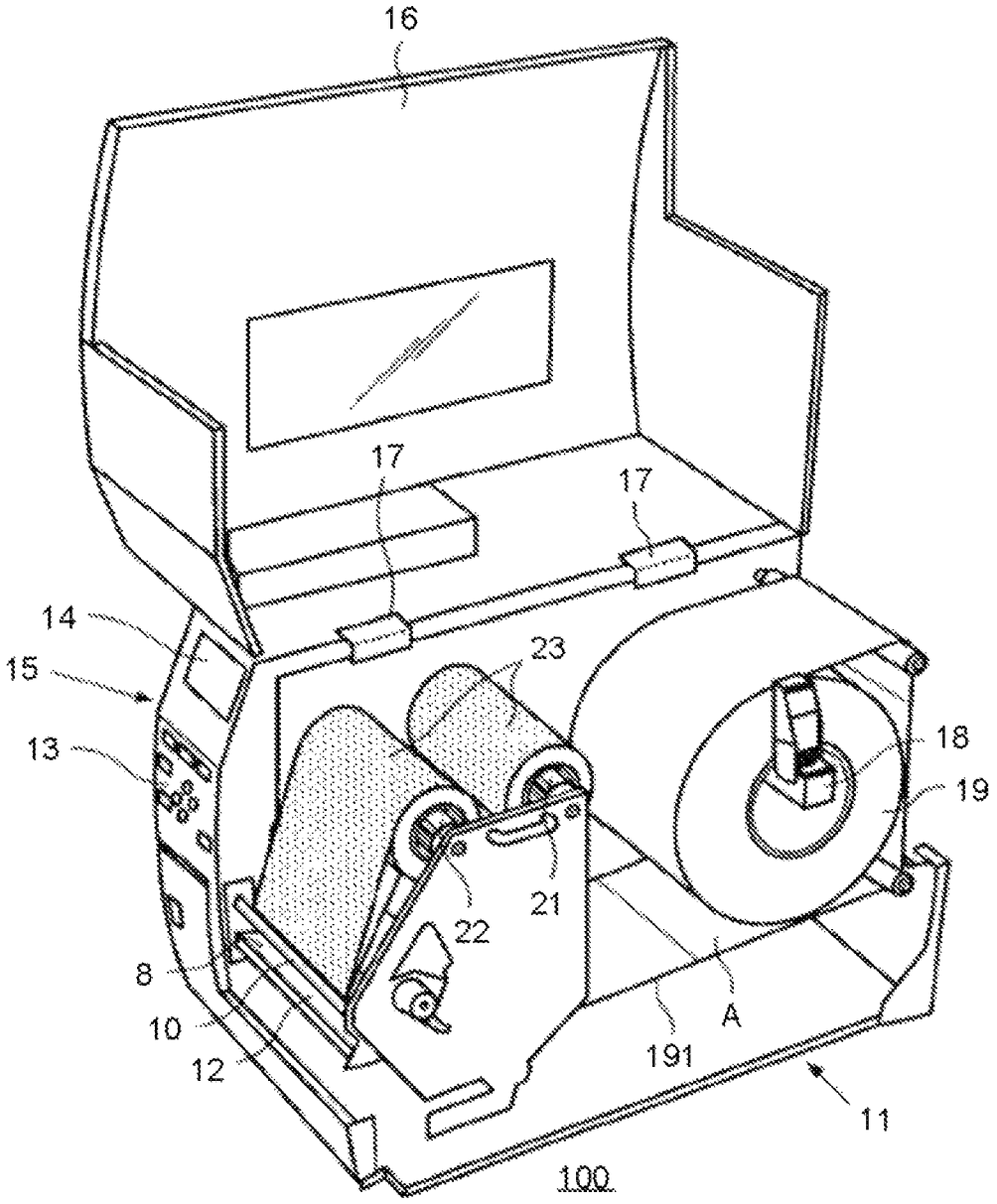
FIG. 2 is a perspective view illustrating the printer with a cover opened.
Figure 3:
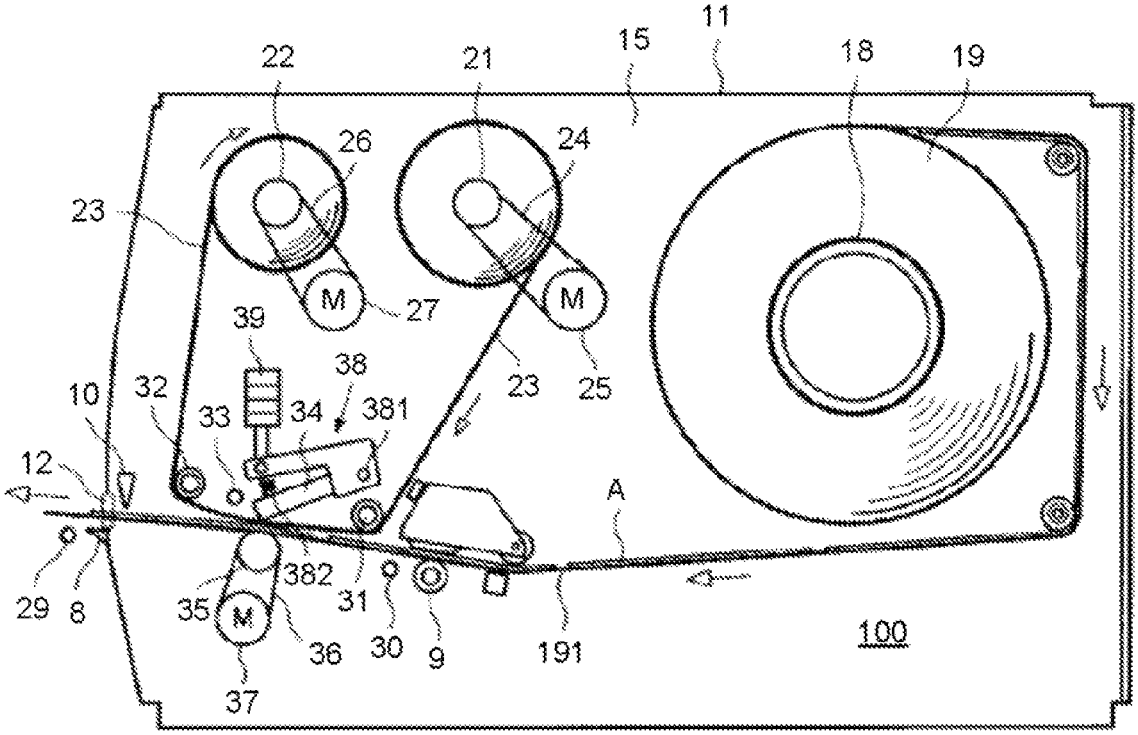
FIG. 3 is a section view illustrating an internal structure of the printer apparatus.

FIGS. 1-3 illustrate a printer apparatus relating to the first embodiment. FIG. 1 is a perspective view of the printer. FIG. 2 is a perspective view of the printer with a cover opened. FIG. 3 is a section view of an internal structure of the printer apparatus.

The present embodiment includes a thermal printer 100 as the printer apparatus. A printing medium of the thermal printer 100 is assumed to be a label temporarily attached to a roll-type backing. The printing medium, which is not limited to the label, may also be a tag or a sheet and the like.

As shown in FIG. 1, a discharge port 12, through which a printed label is discharged, is formed in the front of a main body housing 11 of the printer 100. A cutter 10 is positioned at the upper and the lower portions of the discharge port 12 inside the main body housing 11. A peeling table 8 is positioned opposite to the cutter 10. A control box 15—which includes an input section 13 consisting of various operation keys and a display device 14 and the like—is arranged at the left side of the main body housing 11. A control section for driving and controlling each section of the printer 100 is arranged inside the control box 15.

As shown in FIG. 2, a cover 16 covers the inside of the main body housing 11 and is arranged above the main body housing 11. The cover 16 is rotatable upwards around a hinge 17, which is positioned, at an upper portion of the main body housing 11, on the side of the control box 15.

As shown in FIG. 3, a label roll 19, serving as a printing medium supply unit for supplying a printing medium, is wound in a roll shape. The label roll 19 is rotatably supported a label supply shaft 18 inside the main body housing 11 of the printer 100. The label roll 19 includes a label A affixed to a backing 191 in a peelable manner.

An ink ribbon 23 is mounted on a ribbon supply shaft 21 and a ribbon winding shaft 22. The ribbon supply shaft 21 is driven by a supply motor 25 through a belt 24. The ribbon winding shaft 22 is driven by a winding motor 27 through a belt 26. The winding motor 27 drives the ribbon winding shaft 22, thereby winding the ink ribbon 23 forward. Further, the supply motor 25 drives the ribbon supply shaft 21, thereby rewinding the ink ribbon 23 backward. Herein, 'forward' refers to a direction in which the label roll 19 is conveyed in a feed operation by a platen roller 35 in a direction from an upstream side (right side of the figure) to a downstream side (left side of the figure) in a conveyance direction.

A label sensor 30 is arranged nearby a guide pole 31. The label sensor 30 detects a border of the label A attached to the backing 191, and supplies the detection result to a control section 40 which controls the conveyance of the label roll 19. The control section 40 will be described later. A reflection type or transmission type line sensor formed by combining a light-emitting element such as a LED and a light-receiving element such as a phototransistor may be used as the label sensor 30.

Moreover, a peeling sensor 29 is arranged nearby the discharge port 12. The peeling sensor 29 monitors whether the label A is still affixed to or peeled from the backing 191 after the printing operation. The detection result of the peeling sensor 29 is supplied to the control section 40. The peeling sensor 29 may be a reflection type or transmission type line sensor formed by combining a light-emitting element such as a LED and a light-receiving element such as a phototransistor. The peeling sensor 29 detects that the label A is still affixed to the backing 191 if the transmittance of light is zero or low. Further, the peeling sensor 29 detects that the label A is peeled from the backing 191 if the transmittance of light is high.

Guide poles 31 and 32 are arranged to guide conveyance of the ink ribbon 23. Further, a ribbon monitoring sensor 33 is arranged in the conveyance route of the ink ribbon 23 to detect the used part of the ink ribbon 23. The ribbon monitoring sensor 33 may be a reflection type or transmission type line sensor formed by combining a light-emitting element such as a LED and a light-receiving element, such, as a phototransistor. The ribbon monitoring sensor 33 can detect the whole area in a width direction of the ink ribbon 23. The ribbon, monitoring sensor 33 can distinguish the used part and the unused part of the ink ribbon 23 by sensing the light reflectance or light transmittance of the ink ribbon 23. The ribbon monitoring sensor 33 is positioned further downstream than a thermal head 34 in a conveyance direction of the label roll 19.

Herein, the label, supply shaft 18 is equivalent to a label supply unit for supplying the label A. The ribbon supply shaft 21, the ribbon winding shaft 22, the belts 24 and 26, the supply motor 25 and the winding motor 27 are equivalent to an ink ribbon supply unit for supplying the ink ribbon 23. A pinch roller 9, the platen roller 35, the belt 36 and a stepping motor 37 serving as a line feed motor are equivalent to a conveyance unit for conveying the label roll 19.

The thermal head 34 has a collection of fine heating elements for generating heat by flow a current. The thermal head 34 is positioned opposite to the platen roller 35 across the label roll 19 and the ink ribbon 23. The heating elements generate heat when a current is supplied to the heating elements. When the heating elements are heated, the ink of the ink ribbon 23 is transferred to the label A, thereby the printing operation is carried out.

A head pressing mechanism 38 is rotatably supported by a support shaft 381. The thermal head 34 is also rotatably supported by the support shaft 381. A spring 382 is installed between the head pressing mechanism 38 and the thermal head 34 at a distance from the support shaft 381. The head, pressing mechanism 38 is arranged so that the thermal head 34 is raised against a spring force of the spring 382 with a movable portion of the solenoid 39. The solenoid 39 presses the thermal head 34 against, the ink ribbon 23 when the movable portion is extended, and separates the thermal head 34 from the ink ribbon 23 when the movable portion is retracted.

The head pressing mechanism 38 described herein raises and lowers the thermal head 34 using the solenoid 39 and the spring 382. The head pressing mechanism 38 may also be, for example, a head pressing mechanism for separating the thermal head from the platen roller using an electric actuator.

The guide poles 31 and 32 and the ribbon monitoring sensor 33 may move upwards and downwards in connection with the upward and downward rotation of the thermal head 34 by the head pressing mechanism 38 or other mechanism. Alternatively, the guide poles 31 and 32 may be fixed at a specific position relative to the main body housing 11.

The process of printing on the label A is now described. The thermal head 34 is pressed against the platen roller 35 so that the label roll 19 and the ink ribbon 23 are between the thermal head 34 and the platen roller 35. Then, the stepping motor 37 is driven to rotate the platen roller 35 through the belt 36. The label roll 19 and the ink ribbon 23 are conveyed intermittently from the upstream side to the downstream side in the conveyance direction.

The conveyance of the label roll 19 and the ink ribbon 23 is controlled based on the detection result of the label sensor 30. The winding motor 27 drives the ribbon winding shaft 22 to wind the ink ribbon 23. At the same time, the supply motor 25 drives the ribbon supply shaft 21 to apply back tension to the ink ribbon 23.

A printing signal is supplied to the thermal head 34 while the label roll 19 and the ink ribbon 23 are being intermittently conveyed, and while the heating elements of the thermal head 34 generate heat. In this manner, the printing is carried out on the label A. The printed label A is discharged to the outside from the discharge port 12. The discharged label A becomes individual labels A by cutting the backing 191 with the cutter 10, and the individual label A is separated from the backing 191 to which the label A is temporarily attached.

Figure 4:
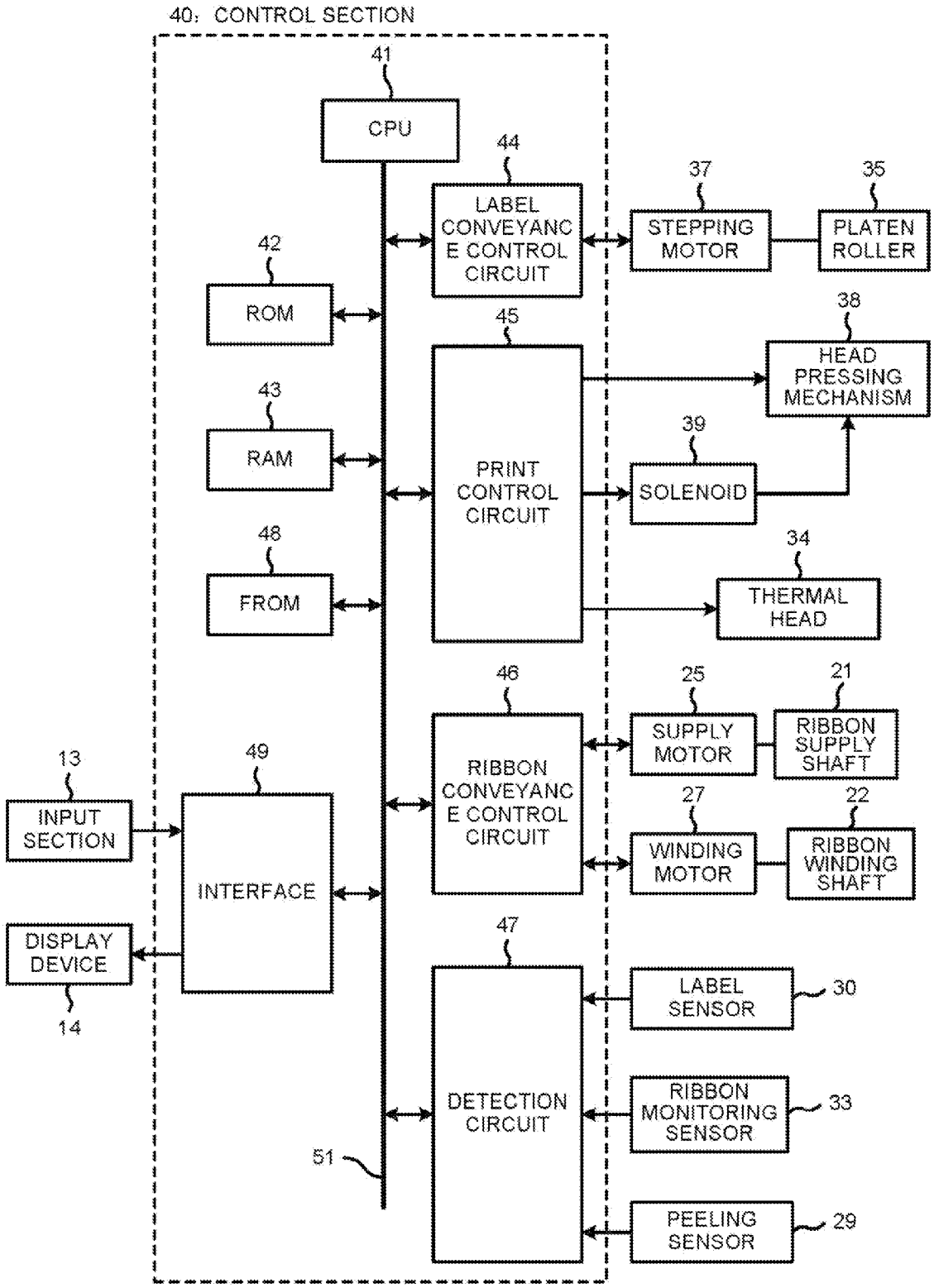
FIG. 4 is a block diagram illustrating a control section of the printer apparatus.

FIG. 4 is a block diagram illustrating a control section of the printer 100.

The control section 40 includes a CPU (central processing unit) 41, a ROM (read only memory) 42, a RAM (random access memory) 43, a label conveyance control circuit 44, a print control circuit 45, a ribbon conveyance control circuit 46, a detection circuit 47, a flash ROM 48, an interface 49 and software. The control section 40 controls the operation of each section connected with each other via a bus line 51.

The CPU 41 is connected with the input section 13 and the display device 14 via the interface 49. The input section 13 may include a keyboard used to input operation commands to the printer. The display device 14 may include an LCD panel for displaying an error message and the like. The display device carries out display functions based on the signal supplied from the control section 40. In addition, the display device 14 may also be concurrently used as the input section 13, such as with a device having a touch panel function.

Control program software for controlling the operation of the printer is stored in the ROM 42. Various parameters used for controlling the operation of the printer and content relating to the registration of the printer and the like are stored in the flash ROM 48. Further, printing data is temporally stored in the RAM 43. The CPU 41 controls the label conveyance control circuit 44, the print control circuit 45, the ribbon conveyance control circuit 46 and the like according to the control program stored in the ROM 42.

The label conveyance control circuit 44 operates the stepping motor 37 under the control of the CPU 41. The ribbon conveyance control circuit 46 operates the supply motor 25 and the winding motor 27.

Under the control of the CPU 41, the print control circuit 45 operates the head pressing mechanism 38 so that the thermal head 34 is driven upwards and downwards by controlling the solenoid 39. When the solenoid 39 is driven, the pressing of the head pressing mechanism 38 is stopped, and the thermal head 34 is raised against the force of the spring 382. When the solenoid 39 is not driven, the thermal head 34 is lowered. The print control circuit 45 also supplies a printing signal to the thermal head 34 based on the printing data stored in the PAM 4. Based on the printing signal, a printing is carried out on the label A.

The detection results of the label sensor 30, the ribbon monitoring sensor 33 and the peeling sensor 20 are respectively input to the detection circuit 47. The detection circuit 47 supplies the detection results to the CPU 41.

Next, the printing operation of the thermal printer 100 is described. First, the printing operation restricting the consumption of the ink ribbon 23 is described.

An operation of printing is started based on input through the input section 13. The control section 40 detects a part of the label (margin) on which printing is not carried out, based on the printing data stored in the RAM 43. The margin may have a length longer than a given length. The control section 40 controls the stepping motor 37 so as to convey the label roll 19 forward. The control section 40 drives, during a period of the margin passing under the thermal head, the solenoid 39 of the head pressing mechanism 38 to drive the thermal head 34 upwards so as to temporally separate the ink ribbon 23 from the label A. The ribbon monitoring sensor 33 detects the used part of the ink ribbon 23. The control section 40 controls, based on the detection result of the ribbon monitoring sensor 33, the print control circuit 45 and the ribbon conveyance control circuit 46 in such a manner that the supply motor 25 rotates to rewind the ink ribbon 23.

When the thermal head. 34 is lowered to be contacted with the ink ribbon 23, the control section 40 conveys the ink ribbon 23 and the label roll 19 simultaneously, and prevents looseness of the ink ribbon 23 (which, causes a printing failure). The ink of the ink ribbon 23 is transferred to the label roll 19 by heating of the thermal head 34, and then the printed label is issued.

In this way, by returning the ink ribbon 23 (which is wound at the side of the ribbon winding shaft 22) to the side of the ribbon supply shaft 21 during a period in which printing is not carried out on the margin, a corresponding consumption amount of the ink ribbon can be restricted.

In addition, in a case where the supply motor 25 and the winding motor 27 are DC motors, for example, in an operation where the printing speed is 5 IPS (Inch Per Second), the printing speed may reach 10IPS when the thermal head 34 contacts with the ink ribbon 23. In this case, the ink ribbon 23 may become loose or be stretched due to the strong momentum when the thermal head 34 contacts with the ink ribbon 23, which may cause the printing failure.

Thus, according to the present embodiment, the supply motor 25 and the winding motor 27 are decelerated and stopped from a state where the thermal head 34 is raised. At the time of a next printing, the thermal head 34 is lowered. The supply motor 25 and the winding motor 27 are accelerated and driven before the thermal head 34 is lowered. In this way, the conveyance speed of the ink ribbon 23 is made the same with that of the label roll 19 when the thermal head 34 contacts with the ink ribbon 23. Thereby, a continuous printing can be carried out in a state where the ink ribbon 23 is tight, but not stretched.

Next, a case is described where the backing 191 between the labels is cut after the printing and the label is issued.

The cutter 10 is positioned at an upper portion nearby the discharge port 12. The label roll 19 is conveyed to the cutter 10 and cut. When the label A is being conveyed towards the position of the cutter, the label sensor 30 detects the border of the label A attached to the backing 191, and controls the conveyance of the label roll 19.

As stated above, the thermal head 34 is raised during a period when the printing is not carried out on the margin, thereby the consumption of the ink ribbon 23 is restricted. In addition, in the printing process, in a case where the cutting position of the label roll 19 passed through the cutter 10, the thermal head 34 is raised to allow the position of the label roll 19 to move back. Such a control is carried out to adjust the inter-label gap of the label A attached to the backing 191.

Herein, the stepping motor 37 is used in the conveyance of the label roll 19. The stepping motor 37 carries out a control to rotate the platen roller 35 in accordance with a stepping angle. For example, in a case of a thermal head 34 having a specification of 8 dot/mm (0.125 mm), the stepping motor 37 adopts a platen roller 35 which moves, for example, 0.125 mm in one step. With such an arrangement of a gear ratio of the stepping motor 37, the movement is carried out in such manner that the label is accurately conveyed for 0.125 mm in one step.

Further, with respect to raising the thermal head 34 from the position in contact with the ink ribbon 23, the raising timing is changed according to the printing speed. In a case where the margin continues in the printing process, the consumption amount of the ink ribbon 23 is restricted if the thermal head 34 is raised. Accordingly, the thermal head 34 is raised when the margin is under the thermal head 34.

In the conventional printing process when there is margin indicated in the printing data, at the point when the printing stops, the label roll 19 is stopped, then the thermal head 34 is raised, and then the label roll 19 is moved. When printing begins again, the label roll 19 is stopped and then the thermal head 34 is lowered. In a case where such an operation is carried out, the throughput of the printer is delayed. Therefore, in actual printing process, the printing operation is continued, and if there is a margin indicated, the operation of raising the thermal head 34 is carried out at the point when the printing is ended.

The thermal head 34 is raised and lowered while the label roll 19 is being conveyed. When the thermal head 34 is raised, the supply motor 25 and the winding motor 27 are decelerated, and stopped when the thermal head 34 is raised completely. When the thermal head 34 is lowered, a control is carried out to accelerate the supply motor 25 and the winding motor 27.

Figure 5:
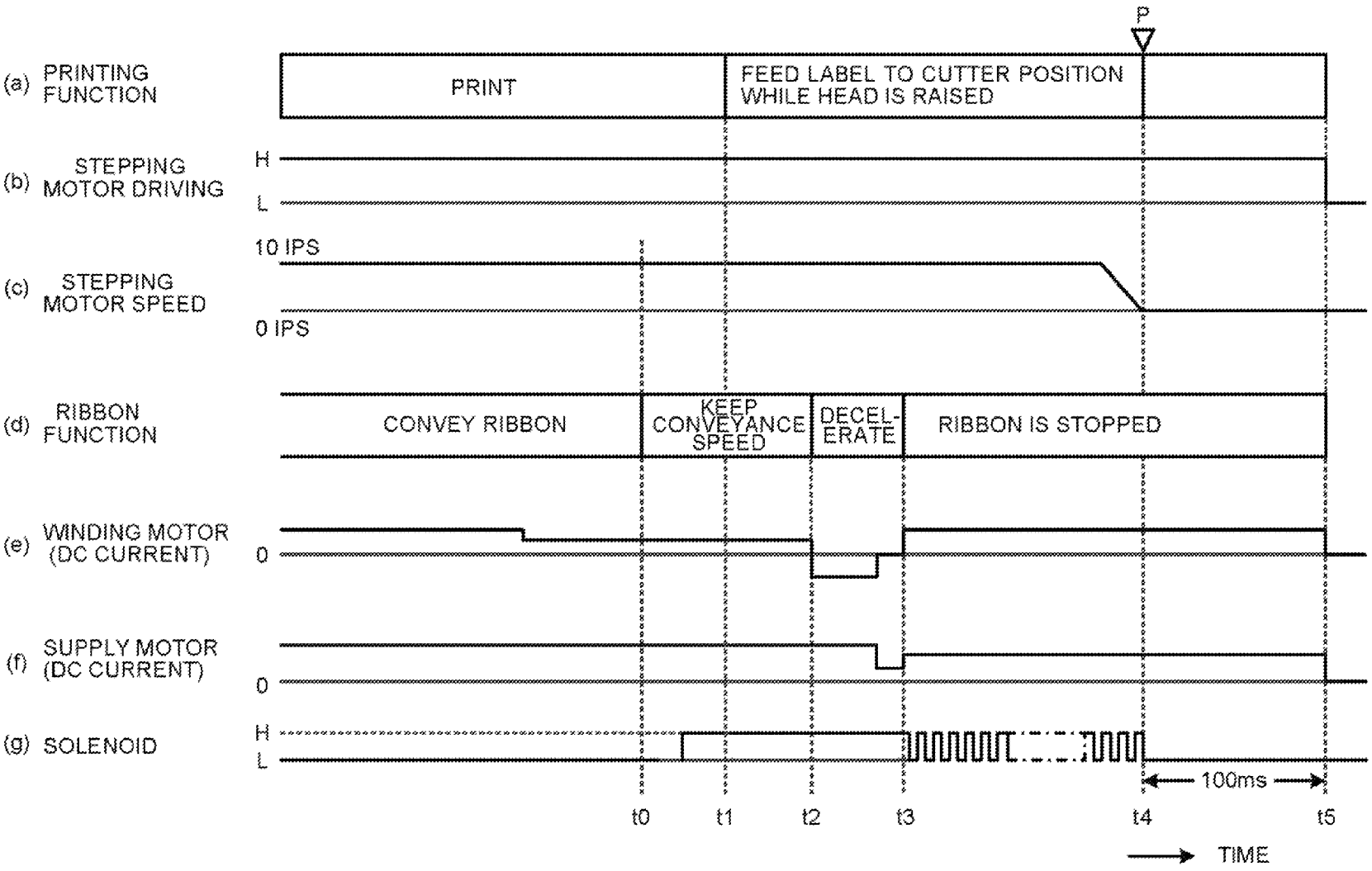
FIG. 5 is a timing chart illustrating operations of various functions, according to the first embodiment.

FIG. 5 is a timing chart illustrating operations of various functions, according to the first embodiment. Specifically, FIG. 5 illustrates, an effect of restricting the extra consumption amount of the ink ribbon from the moment the printing is ended to the moment the label is cut.

FIG. 5(*a*) illustrates a transition of the printing function over time. The printing is carried out on the label until the time t1. From the time (time t1) when the printing is ended to the time t4, the label A is conveyed to the position of the cutter 10 while the thermal head 34 is raised. After the time (100 ms) from the time t4 to the time t5 elapses, the label A is cut by the cutter 10.

FIG. 5(*b*) illustrates a driving state of a line feed motor, that is, the driving state of the stepping motor 37. The stepping motor 37 is driven at the level H, and is stopped at the level L.

FIG. 5(*c*) illustrates the speed of the stepping motor 37. The value 0 IPS indicates that the stepping motor 37 is in a stopped state. In the printing process, the printing speed is set to be corresponding to a standard speed of at printer, for example, 10 IPS. The stepping motor 37 is decelerated before the time t4 when the label is conveyed while the thermal head 34 raised, and is stopped at the time t4. In this way, the stepping motor 37 still rotates at the printing speed even if the printing is ended, and the label A is fed to a position P (t4) of the cutter 10 in this state.

FIG. 5(*d*) illustrates the transition of the ink ribbon function over time. FIG. 5(*e*) illustrates a driving state of the winding motor 27, and FIG. 5(*f*) illustrates a driving state of the supply motor 25.

As shown in FIG. 5(*d*), before and after the time t1 when the printing is stopped, the ink ribbon 23 keeps the conveyance speed based on the winding motor 27 as shown in FIG. 5(*e*). Then the ink ribbon 23 is decelerated from the time t2 to the time t3, and is stopped after the time t3.

In addition, FIG. 5(*e*) and FIG. 5(*f*) illustrate a variation of values of DC current for driving the winding motor 27 and the supply motor 25 in the function of the ink ribbon 23 shown in FIG. 5(*d*).

That is, in a period from the time t0 before the time t1 when the printing is stopped to the time t2 after the time t1, the conveyance speed so far is kept at a constant speed. In a period from the time t2 to the time t3, the DC current of the winding motor 27 is set to a negative value to decelerate the winding motor 27. The current of the winding motor 27 is set to zero before the deceleration is ended, and is kept at zero until the time t3. During a period when the current of the winding motor 27 is zero, the current value of the supply motor 25 is lowered somewhat.

After the deceleration of the ink ribbon 23 is ended, the current of the winding motor 27 and the supply motor 25 is increased somewhat, and then is kept at the increased level until the time to when the label is cut. In addition, in order to maintain the tension of the ink ribbon 23, DC current is continued to be applied to the winding motor 27 and the supply motor 25 even if the ink ribbon 23 is stopped.

FIG. 5(*g*) illustrates a control signal for driving the solenoid 39 which controls the raising and lowering of the thermal head 34. The level H represents a state where the solenoid 39 is turned on, and the level L represents a state where the solenoid 39 is turned off. After the solenoid 39 is turned on, it takes a while to completely raise the thermal head 34 by pulling the movable portion of the solenoid 39 due to the existence of the spring 382. Therefore, it is set that the solenoid 39 is turned on at a time a little earlier than the time t1 when the printing is ended (stopped).

As it is acceptable to merely maintain the raised thermal head 34 in a raised state, chopper driving is set during a period from the time t3 to the time t4 as shown in FIG. 5(*g*). In this way, the heat generated due to the current continuously applied to the solenoid 39 when the thermal head 34 is raised is restricted, thereby preventing the operation failure of the solenoid 39.

At the time t4 when the stepping motor 37 is stooped from the deceleration as shown in FIG. 5(*e*), the driving of the solenoid 39 is stopped. Thereby, the thermal head 34 is lowered.

In addition, looseness of the ink ribbon 23 is generated during a time period (e.g. 100 ms) from the time (time t4) when the driving of the solenoid 39 is stopped to the time (time t5) when the conveyance of the ink ribbon 23 is stopped. However, when the original power of the printer is turned on and the thermal head 34 is raised, the tension of the ink ribbon 23 cannot be maintained. Therefore, in restarting the printing process, an operation of applying tension to the ink ribbon 23 is carried out.

Therefore, even in a case where the ink ribbon 23 is stopped in a loosened state, the looseness problem can be solved by an operation of controlling the ink ribbon 23 when the printer is started. Thus, the problem caused due to the driving stop of the solenoid 39 at the time t4 can be solved.

Further, the stepping motor 37 is set to have a standby time (e.g. 50 ms) in the pre-hold (preceding process) for various operations. The stepping motor 37 is also set to have a standby time (e.g. 100 ms) in the post hold (post process) for various operations after the printing is ended. The timing to lower the thermal head 34 after the printing is ended is limited in the 100 ms during which the stepping motor 37 is being driven.

Then, the stepping motor 37 is stopped at the position P of the cutter. In actual practice, the processing of cutting the label A using the cutter 10 is carried out after the stepping motor 37 is driven until the time t5 shown in FIG. 5.

In addition, as to the stepping motor 37, since the phase state of the motor is not known immediately after the power is turned on, the motor can reach a driving start position by output ting a specific signal and holding for a certain time. The certain time mentioned herein refers to the pre-hold time. Further, as the motor will rotate due to rotational inertia after the motor is stopped, a specific time until the micro vibration stops is set. The specific time mentioned herein refers to the post hold time.

In this way, the timing to lower the thermal head 34 to contact it with the ink ribbon is set to be a time when the stepping motor 37 is in the stop state after decelerating from the constant speed. Originally, the ink ribbon 23 is accelerated when the head contacts with the ink ribbon. By holding it in the stopped state, after the stepping motor 37 is stopped, the stop control of the ink ribbon 23 is released in a state where the thermal head 34 is completely stopped. Then, the cutting operation is carried out at a proper timing when the overall throughput so far is not delayed.

The control of the ink ribbon 23 carries out a backward rotation operation after the label is cut, until the proper printing position is reached. The operation at this time carries out the same control as before. Therefore, in the next printing start state, the ink ribbon is not loosened and a stable print quality can be achieved.

In the present embodiment, the stepping motor is stopped and the operation of lowering the thermal head is completed during the post hold time required to stop the stepping motor, in this way, even in the peripheral processing process such as the conveyance to the cutter position, the existing throughput can be maintained while the consumption amount of the ink ribbon can be restricted.

A Second Embodiment

Next, the second embodiment is described. In the embodiment described above, the stepping motor is stopped and the operation of lowering the thermal head is completed during the post hold time of the stepping meter. In the second embodiment the stepping motor 31 performs the label feed operation (forward feeding) to convey the gap between the labels to the cutter position during the pre-hold time required to drive the stepping motor and to a position of an RFID (Radio Frequency Identification) tag. The RFID tag has a position for writing an ID under the label. At the position, there is an antenna section behind the thermal head. The target ID (i.e., the print data) will not be written unless the tag is moved to a position near the antenna section. As the operation for this, the preceding and post operation of the RFID tag are required.

In the forward rotation feeding of the label roll 19 or the forward rotation feeding to the position of the RFID tag, the head is raised and then the LP motor is operated, and the head is lowered after the LF motor is stopped. The throughput seems to foe reduced by such a control at the first sight. However, there are a pre-hold and a post hold time required to control the stepping motor 37 and the ink ribbon 23. The consumption amount of the ink ribbon can be reduced without reducing the overall throughput as long as the operation of raising and lowering the head can be completed in this time period.

In the present embodiment, the consumption of the ink ribbon can be reduced without reducing the throughput by carrying out a series of operations in the forward rotation feeding or the forward rotation feeding to the position of the RFID tag.

The invention described herein is not limited to the present embodiment. For example, in the forward rotation feeding operation for cutting the last piece of label using a rotary cutter which carries out cutting while the printing is being carried out, during the post-hold time, the stepping motor is stopped and the operation of lowering the thermal head is completed. By carrying out change on such a control, the consumption amount of the ribbon can be reduced even in a case of a cutting operation using a rotary cutter.

While certain embodiments have been described, these embodiments have been presented by way of example only, and are not intended to limit the scope of the invention. Indeed, the novel embodiments described herein may foe embodied in a variety of other forms; furthermore, various omissions, substitutions and changes in the form of the embodiments described herein may be made without departing from the spirit of the invention. The accompanying claims and their equivalents are intended to cover such forms or modifications as would fail within the scope and spirit of the invention.

What is claimed is:

1. A printer apparatus, comprising:

a printing medium supply unit configured to supply a printing medium;

an ink ribbon supply unit configured to supply an ink ribbon;

a printing medium conveyance unit including a platen roller configured to convey the printing medium;

a thermal head arranged at a position opposite to the platen roller with the printing medium and the ink ribbon therebetween, and configured to carry out printing by transferring the ink of the ink ribbon to the printing medium;

a head pressing mechanism configured to change a distance between the thermal head and the platen roller or a pressure force between the thermal head and the platen roller while the thermal head and the platen roller are in press contact; and a control section configured to:

control movement of the head pressing mechanism so that the pressure force is reduced before the printing is ended and the thermal head is raised away from the platen roller after the printing is ended, control the printing medium conveyance unit to convey the printing medium to a cutting position, and control the head pressing mechanism to lower the thermal head into contact with the platen roller immediately after the printing medium is cut.

2. The apparatus according to claim 1, wherein the ink ribbon supply unit consists of a supply shaft and a winding shaft which wind the ink ribbon from the supply shaft to the winding shaft during printing.

3. The apparatus according to claim 2, wherein the winding shaft is driven by a winding motor to wind the ink ribbon, and a current to the winding motor driving the winding shaft is reversed and then stopped to decelerate and stop the ink ribbon.

4. The apparatus according to claim 3, wherein the supply shaft is driven by a supply motor to maintain tension in the ink ribbon, and a current to the supply motor is reduced after the current to the winding motor is reduced and stopped.

5. The apparatus according to claim 4, wherein the ink ribbon is stopped after the current to the supply motor is stopped.

6. The apparatus according to claim 1, wherein the ink ribbon supply unit reverses the ink ribbon to a printing position after the recording medium is cut and while the thermal head is raised.

7. The apparatus according to claim 6, wherein the printing position is determined by the control section according to output from a ribbon monitoring sensor.

8. The apparatus according to claim 1, wherein the cutting position is determined by the control section according to output from a printing medium sensor.

9. The apparatus according to claim 1, wherein the printing medium supply unit is configured to supply RFID tags as the printing medium.

10. A printer apparatus, comprising:

a printing medium supply unit configured to supply a printing medium;

an ink ribbon supply unit configured to supply an ink ribbon;

a printing medium conveyance unit including a platen roller configured to convey the printing medium;

a thermal head arranged at a position opposite to the platen roller with the printing medium and the ink ribbon therebetween, and to carry out printing by transferring the ink of the ink ribbon to the printing medium;

a head pressing mechanism configured to change a distance or a pressure force between the thermal head and the platen roller; and a control section configured to:

control the printing medium conveyance unit to convey the printing medium to a printing position, control the ink ribbon supply unit to rewind an unused portion of the ink ribbon while the printing medium conveyance unit conveys the printing medium to the printing position and while the thermal head raised.

11. The apparatus according to claim 10, wherein, after the printing is ended, the control section controls the head pressing mechanism to raise the thermal head, controls the printing medium conveyance unit to convey the printing medium to a cutting position, and controls the head pressing mechanism to lower the thermal head during a period immediately after the printing medium is cut.

12. The apparatus according to claim 11, wherein the printing medium conveyance unit includes a stepping motor.

13. The apparatus according to claim 12, wherein a driving signal to the stepping motor is reduced before the printing medium reaches the printing position.

14. The apparatus according to claim 10, wherein the head pressing mechanism includes a solenoid which is turned on to raise the thermal head, turned off to lower to lower the thermal head, and set to a chopper driving mode while the thermal head is raised.

15. The apparatus according to claim 10, wherein the printing position is determined by the control section according to output from a ribbon monitoring sensor.

16. The apparatus according to claim 10, wherein the cutting position is determined by the control section according to output from a label sensor.

17. A printing method comprising the steps of:

printing on a printing medium with a thermal head and an ink ribbon, the printing medium and the ink ribbon pressed between the thermal head and a platen roller while printing;

raising a head pressing mechanism to reduce a pressure force between the thermal head and the platen roller while the thermal head and the platen roller are in press contact before the printing is ended and to raise the thermal head away from the platen roller after the printing is ended the thermal head while printing;

conveying the printing medium to a cutting position while the thermal head is raised and after printing has stopped; and lowering the thermal head before the printing medium is cut.

18. The method according to claim 17, wherein the ink ribbon is spooled from a supply shaft to a winding shaft during printing and during a period after printing stops.

19. The method according to claim 18, wherein the ink ribbon is reverse spooled from the winding shaft to the supply shaft after the recording medium is cut and before the thermal head is fully lowered.

20. The method according to claim 19, further comprising:

conveying the printing medium to a printing position after the recording medium is cut and before the thermal head is lowered.

* * * * *